United States Patent [19]

Overman

[11] 4,292,391

[45] Sep. 29, 1981

[54] SILVER HALIDE DEVELOPMENT ACCELERATORS

[75] Inventor: Joseph D. Overman, Wilmington, Del.

[73] Assignee: E. I. Du Pont de Nemours and Company, Wilmington, Del.

[21] Appl. No.: 119,296

[22] Filed: Feb. 6, 1980

[51] Int. Cl.[3] ..... G03C 5/30

[52] U.S. Cl. ..... 430/267; 430/268; 430/485; 430/487; 430/600; 430/615

[58] Field of Search ..... 430/267, 268, 485, 600, 430/614, 487, 615

[56] References Cited

U.S. PATENT DOCUMENTS

| | | | |
|---|---|---|---|
| 2,743,180 | 4/1956 | Carroll | 430/615 |
| 3,161,515 | 12/1964 | Welsh | 430/615 |
| 3,185,570 | 5/1965 | Welsh | 430/615 |
| 3,554,757 | 1/1971 | Kuwabara et al. | 430/615 |
| 3,782,945 | 1/1974 | Shimamura et al. | 430/268 |
| 3,785,822 | 1/1974 | Overman | 430/268 |
| 3,899,331 | 8/1975 | Bloom et al. | 430/615 |
| 3,969,117 | 7/1976 | Sakai et al. | 430/268 |

*Primary Examiner*—J. Travis Brown

[57] ABSTRACT

Pyrazolo [3,4-d] pyrimidine, and derivatives thereof, can be added to either a silver halide emulsion, or to a hydroquinone (litho) developer to accelerate development and reduce the induction period.

8 Claims, No Drawings

SILVER HALIDE DEVELOPMENT ACCELERATORS

BACKGROUND OF THE INVENTION

A combination of special emulsions and developers is required to give the high contrast, sharp tone, low fog and high top density characteristic of lithographic films. Such films are usually composed of one or more silver halide emulsions in hardened, macromolecular, water-permeable, organic colloid binders, deposited on a suitable support. Developers commonly used to obtain this curve shape, hereafter litho-type developers, are based mainly on hydroquinone. This combination of emulsion-developer is mainly used for the production of halftone dot images for letterpress, lithography and the like.

It is known that litho-developers require an induction period prior to development, followed by a period in which so-called "infectious development" occurs, giving rise to the high gradient necessary for good dot quality. This phenomenon is discussed by, for example, James, in the Journal of Photographic Science, Vol. 10 (1944), p. 271, and in Photographic Science and Engineering, Vol. 12 (1968), p. 67, and elsewhere.

To hasten the induction period and, hence, increase the effective speed of litho-type developer systems, and to improve developer access time, many additives have been tried. For example, it has been observed that development of exposed emulsions in mildly alkaline hydroquinone is accelerated if the emulsion is first bathed in allylthiourea. However, this results in a serious fog problem. Antifogging agents can be used to reduce this fog but they also reduce the speed of the system. Overman, in U.S. Pat. No. 3,785,822 "Photographic Emulsions and Developers Containing 2-Mercapto Heterocyclic Compounds" teaches the use of certain 2-mercapto-substituted heterocyclic compounds to increase system speed even in the presence of stabilizers and antifoggants. However, there is a need for other compounds of this type which have lower toxicity than mercaptans.

SUMMARY OF THE INVENTION

In order to reduce the induction period of litho-type developers there is added to the photosensitive silver halide emulsion component of litho film, or to the developer, an accelerator selected from the group consisting of:

(a) a pyrazolo pyrimidine of the structure

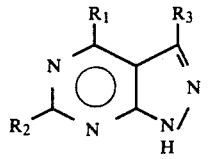

wherein $R_1$ and $R_2$=H, OH, or $NH_2$, with the proviso that when $R_1$=OH, $R_2$ must be H or $NH_2$, and $R_3$=H or $—O(CH_2)_n—OH$; and wherein n is an integer from 1 to 3;

(b) a purine of the structure:

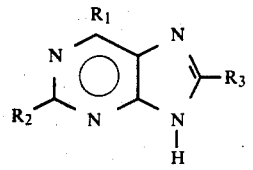

wherein $R_1$=OH or $NH_2$; $R_2$=H,$NH_2$ or OH with the proviso that when $R_1$=OH, $R_2$=H or $NH_2$, and when $R_1$=$NH_2$, $R_2$=H; $R_3$=H,OH, $NH_2$ or $CH_3$ with the proviso that when $R_3$=OH, $R_1$ and $R_2$ may be OH; when $R_3$=$NH_2$, $R_1$ must be OH and $R_2$ must be H; and when $R_3$=$CH_3$, $R_1$ and $R_2$ must be OH.

(c) a 4-aza-benzimidazole of the structure:

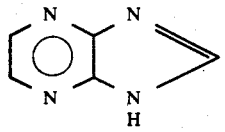

wherein R=H or $NH_2$;

(d) 8-azaguanine

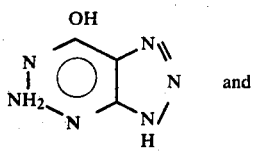

and (e) phthalazine

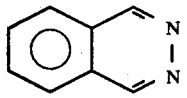

In a typical embodiment, pyrazolo[3,4-d]pyrimidine, or a derivative thereof, is added in small amounts (e.g. fractions of a gram per 1.5 moles of silver halide) to the silver halide emulsion or to the developing solution, the latter being a litho-type or conventional high free sulfite developer containing hydroquinone, methyl-hydroquinone, catechol, pyrogallol, or the like. In this way it is possible to shorten the induction period without alteration of the sensitometric characteristics of the emulsion in litho-type developers, and to eliminate the need for a primary developing agent, e.g. N-methyl-p-aminophenol or a 3-pyrazolidone admixed with hydroquinone in a super-additive mixture.

DETAILED DESCRIPTION OF THE INVENTION

The accelerators of this invention include these compounds: pyrazolo[3,4-d]pyrimidine; 4-amino-6-hydroxypyrazolo[3,4-d]pyrimidine; 4-amino-pyrazolo[3,4-d]pyrimidine; 4-hydroxypyrazolo[3,4-d]pyrimidine; 4-amino-3(2-hydroxyethoxy)pyrazolo[3,4-d]pyrimidine; 3-amino-pyrazolo[3,4-d]pyrimidine; 6-hydroxy purine; 6-amino purine; 2-amino-6-hydroxy purine; 8-azaguanine; 2,6-diamino-8-purinol; 2,8-dihydroxy adenine; 6-hydroxy-8-amino-purine; 4-azabenzimidazole; 2,6-dihydroxy-8-methyl purine; and phthalazine, among others. These accelerators can be admixed with the emulsion in quantities of $1\times10^{-2}$ millimoles to 5 millimoles/1.5 moles of silver halide, or may be incorporated into the developing solution in the range of 0.0005 to 2 grams per liter of solution. In either case they produce the same sensitometric curve shape as would be obtained in their absence, along with a substantial increase in emulsion speed and reduction of the induction period. Surprisingly, these accelerators do not objectionably increase the fog of the photographic film as is the case with many speed-increasing adjuvants.

Alternatively, when admixed in developing solutions containing substantial amounts of at least one antifoggant and/or hydroquinone development restrainer such as 5-nitroindazole, 5-nitrobenzimidazole, 1,2-naphthotriazole, an alkali metal bromide (preferably KBr), or polyethylene oxide, they overcome the restraining action of said antifoggant and prevent speed loss without increasing the level of fog.

Suitable developer solutions may contain the following ingredients:

Ingredients

- Ammonium, sodium, or potassium sulfite
- Sodium or potassium carbonate or borate (depending on desired degree of buffering)
- Sodium bromide
- Hydroquinone
- Accelerator of the invention
- An aldehyde/alkali metal bisulfite adduct e.g. formaldehyde/sodium bisulfite adduct
- Sodium or potassium hydroxide to adjust pH to $10.5\pm1$
- Water The accelerators of this invention may be added to the emulsion at any stage of manufacture that preferably after digestion and just prior to coating. Silver halide emulsions of various types may be used such as nonsensitized, X-ray, panchromatic, or orthochromatic emulsions in which the silver halide is for example, silver chloride, bromide, chlorobromide, bromoiodide, chloroiodide, or a chloride-iodide-bromide mixture. Such emulsions are preferably brought to their optimum sensitization by digestion with sulfur and gold in known manner. The principal constituent of the emulsion is gelatin or any other natural organic, macromolecular, water-permeable colloid binding agent. Part or all of the gelatin or other natural colloid can be replaced with synthetic colloid binding agents, e.g., partially hydrolyzed polyvinyl acetates, dispersed aqueous pol(ethyl acrylate), polyvinyl ethers and acetals containing a large number of extralinear —$CH_2$—CH—OH groups, and hydrolyzed interpolymers of vinyl acetate and unsaturated addition-polymerizable compounds such as maleic anhydride, acrylic and methacrylic acid and their ethyl esters, and styrene. These and other suitable colloids are disclosed in greater detail in U.S. Pat. Nos. 2,276,322, 2,276,323, 2,347,811, 3,142,568 and 3,203,804.

Whatever its composition, the silver halide emulsion may be coated on any conventional base or support, such as glass, metal, various waterproof papers, cellulose derivatives, super polymers such as nylon, polyvinyl chloride, polystyrene, polyethylene terephthalate, etc. These emulsions may also contain other conventional adjuvants such as sensitizers, coating aids, dyes, hardeners, etc. For example, the emulsions of this invention may be modified and sensitized by the addition of such general emulsion sensitizers as phenyl isothiocyanate, sodium thiosulfate and alkylthiocyanate; metal compounds such as gold, platinum, palladium, iridium, rhodium, lead, etc.; additional antifoggants or stabilizers such as the triazaindenes and the tetraazaindenes; the polyoxyethylene compounds described in U.S. Pat. Nos. 2,531,832, 2,400,532, and 2,533,990; hardeners such as glutaraldehyde, formaldehyde and other aliphatic aldehydes; dimethylol urea and trimethylol melamine; chrome alum and other chromium compounds, etc.

The invention is illustrated by the following examples.

EXAMPLE 1

A monodisperse, gelatino-silver halide, litho-type emulsion (ca. 80 mole % silver chloride, 18.5 mol % silver bromide and 1.5 mol % silver iodide) was prepared, and sensitized with gold and sulfur salts as is conventional. After addition of antifoggants, hardeners and wetting agents the emulsion was divided into four portions. Portion A (the control) was coated on a subbed polyethylene terephthalate film support at a coating weight of about 69 mg Ag halide/$dm^2$. To portions B, C, and D was added, respectively, 0.1 g, 0.175 g, and 0.25 g, per 1.5 moles of silver halide, of 4-hydroxy-pyrazolo-[3,4-d]-pyrimidine dissolved in water. These portions were then coated on a polyethylene terephthalate film support similar to the control. Each coating was then over-coated with a thin, hardened stratum of gelatin and given a $10^{-2}$ second exposure through a $\sqrt{2}$ step wedge on a Mark 6 Sensitometer produced by E.G. and G. Co. (GE Type FT-118 Xenon Flash Tube), and containing an 0.6 neutral density filter and a No. 207763, $10^{-2}$ compensating alternator grid. The exposed strips were then developed for sixty seconds in a developer of this composition:

| | | |
|---|---|---|
| $K_2SO_3$ (anhydr.) | — | 50.0 g |
| $K_2CO_3$ (anhydr.) | — | 40.0 g |
| Hydroquinone | — | 25.0 g |
| KBr | — | 2.0 g |
| 5-nitroindazole | — | 0.05 g |
| Polyoxyethylene (M.W. ca. 4,000) | — | 0.02 g |
| Water to 1.0 liter | — | pH 10.3 |

The developed strips were then fixed, washed and dried. The following sensitometric data was obtained:

| Portion | Contrast | Speed | Base + Fog |
|---|---|---|---|
| A | ~1 | 100 | 0.04 |
| B (1.0 g accelerator) | 2.5 | 165 | 0.04 |
| C (0.175 g accelerator) | 3.6 | 196 | 0.04 |
| D (0.25 g accelerator) | 2.6 | 171 | 0.04 |

EXAMPLE 2

A negative-working monodisperse, gelatino-silver halide (ca. 98.5 mol % silver bromide and ca. 1.5 mole % silver iodide) emulsion was prepared and sensitized in conventional manner with gold and sulfur salts. After addition of antifoggants, wetting agents, and hardeners the emulsion was divided into five portions. To each portion was added the accelerator (dissolved in water) listed below, and it was then coated (ca. 70 mg silver halide/$dm^2$) as described in Example 1. The coatings were exposed as described in Example 1 and further developed in the developer of Example 1. The time elapsed before the shoulder of the H&D sensitometric curve shape for each sample of coated film became visible (the induction period) is also shown below:

| Portion | Accelerator Added[1] | Induction Period (sec.) |
|---|---|---|
| A | control - none | 25 |
| B | 4-amino-6-hydroxypyrazolo-[3,4-d] pyrimidine | 6 |
| C | pyrazolo-[3,4-d]-pyrimidine | 6 |
| D | 4-aminopyrazolo-[3,4-d]-pyrimidine | 7 |
| E | 4-hydroxypyrazolo-[3,4-d]-pyrimidine | 8 |

[1]0.3 g/1.5 moles of silver halide in B, C, & D, 0.1 g/1.5 moles silver halide in E All of the above had good speed and high gradient except for the control.

EXAMPLE 3

The emulsion of Example 2 was prepared and split into two portions. Portion A (the control) was coated without further treatment. To portion B was added 4-hydroxypyrazolo-[3,4-d]-pyrimidine (0.5 g/1.5 moles silver halide) and it was then cooled. The coatings were exposed as in Example 2 and then developed for about 3 minutes in a developer composed of 20 g ascorbic acid in sufficient distilled water to make 1 liter, pH=10.0 (adjusted with KOH). The time to develop the shoulder (induction period) of each portion was as follows:

| Portion | Induction Period (sec.) |
|---|---|
| A - control | 60 |
| B | 15 |

EXAMPLE 4

Two developer solutions were prepared having the following composition:

| | |
|---|---|
| $K_2SO_3$ | - 50 g |
| $K_2CO_3$ | - 40 g |
| Hydroquinone | - 25 g |
| KBr | - 2 g |
| 5-nitroindazole | - 0.0375 g |
| polyoxyethylene (M.W. ca. 4000) | - 0.075 g |
| Dist. water to 1 liter (adjust pH to 10.3) | |

Developer solution A (the control) was used to process an exposed control film sample from Example 2. Developer solution B was further treated by adding 0.25 g of 6-hydroxy purine accelerator and then used to develop an exposed control film sample from Example 2. The development time for both was 90 seconds. The induction period was as follows:

| Developer | Induction Period (sec.) |
|---|---|
| A - control | 28 |
| B - with 6-hydroxy purine | 4 |

EXAMPLE 5

The emulsion of Example 2 was prepared, and three film samples (no accelerator) were coated with this emulsion. These films were exposed as described in Example 2. Three developer solutions were prepared as follows:

| Ingredient | Amount Added (g) A | B | C |
|---|---|---|---|
| $K_2SO_3$ | 50 | 50 | 50 |
| $K_2CO_3$ | 40 | 40 | 40 |
| Hydroquinone | 25 | 25 | 25 |
| KBr | 2 | 2 | 2 |
| 5-nitroindazole[1] | None | 0.0375 | 0.0375 |
| Polyoxyethylene[1] (M.W. ca. 4000) | None | 0.075 | 0.075 |
| 2-amino-6-hydroxy-purine[2] | None | None | 0.5 |
| Water was added to 1 liter and the pH adjusted to about 10.3 | | | |

[1]These ingredients act as restrainers or antifoggants
[2]The accelerator

One of each of the above referenced films was developed in each of the developers, and the following induction periods noted:

| Developer Used | Induction Period (sec.) |
|---|---|
| A | 7 |
| B | 28 |
| C | 5 |

This example demonstrates that the accelerators of this invention can be used to restore developer activity and to overcome the restraining action of commonly used developer antifoggants while taking advantage of their benefits.

EXAMPLE 6

The emulsion of Example 2 was prepared and divided into two portions. Portion A (the control) was coated without further treatment. To portion B was added 4-aza-benzimidazole (0.25 g/1.5 moles silver halide). Both portions were coated, exposed and developed as described in Example 2. The induction period of each was as follows:

| Portion | Induction Period (sec.) |
|---|---|
| A | 18 |
| B | 4 |

EXAMPLE 7

The emulsion of Example 2 was prepared without an accelerator. Five coatings of this emulsion were made and exposed as described in this example.

Five developer solutions were prepared as described in Example 5, Developer A (no restrainer added). The following ingredients were then added (accelerators added as shown):

| Developer | Speed Adjuvant (g/l) |
|---|---|
| 1 | None - control |
| 2 | None - 12.1 g benzotriazole restrainer |
| 3 | Like 2 plus 0.25 g 4-azabenzimidazole |
| 4 | Like 2 plus 0.75 g 6-hydroxy purine |
| 5 | Like 2 plus 0.25 g 4-hydroxypyrazole-[3,4-d]-pyrimidine |

An emulsion strip was processed in each of the above developers (ca. 60 sec. development time) and the induction period observed as follows:

| Developer Used | Induction Period (sec.) |
|---|---|
| 1 | 8 |
| 2 | 31 |
| 3 | 4 |
| 4 | 10 |
| 5 | 10 |

EXAMPLE 8

A spectrally sensitized (green region of the spectra), lithographic emulsion was made according to the teachings of Nottorf, U.S. Pat. No. 3,142,568 "Photographic Emulsions, Elements, And Processes" (1964). The emulsion was coated on a suitable support and exposed as described in Example 1 (except for the use of a 1.0 neutral density filter). Two coatings were made. A developer solution like that described in Example 1 without the 5-nitroindazole and the polyoxyethylene was prepared and divided into two portions. Portion A (the control) was used to develop one of the film coatings. The second portion (B) was further treated by adding 0.08 g 4-azabenzimidazole per liter of developer. The second film coating was processed in this solution. Processing time was ca. 60 seconds and the induction period was as follows:

| Developer | Induction Period (sec.) |
|---|---|
| A | 9 |
| B | 6 |

EXAMPLE 9

The emulsion of Example 2 was prepared and divided into three portions. Each portion was coated without further treatment and exposed as described therein.

The following developer solution was prepared:

| | |
|---|---|
| $K_2SO_3$ | - 50 g |
| $K_2CO_3$ | - 20 g |
| 4-methyl catechol | - 20 g |
| KBr | - 2 g |

Dist. water to 1 liter, pH adjusted to 10.3 This solution was then divided into three portions and further treated as follows:

| Portion | Treatment |
|---|---|
| A | None - control |
| B | 1.65 g/l benzotriazole added |
| C | B plus 0.25 g/l 4-azabenzimidazole |

A film sample from above was then processed in each of the developers (ca. 60 sec. processing time) and the induction period measured as follows:

| Developer | Induction Period (sec.) |
|---|---|
| A | 4 |
| B | 23 |
| C | 12 |

This example demonstrates that the accelerators of this invention can be used with hydroquinone derivatives as well. Indeed, one advantage of using the accelerators of this invention lies in their ability to reduce or control the induction period of the film in developers containing hydroquinone. Yet another disadvantage lies in the use of a lower pH and/or lesser amount of antifoggant, along with a reduction in speed loss and a longer developer shelf life.

These advantages are achieved without sacrifice of the sensitometric or physical characteristics of the film. Still other advantages will be apparent to those skilled in the art.

I claim:

1. In a process for developing a photographic light-sensitive material for the graphic arts which comprises image-wise exposing and infectiously developing a photographic film comprising a support having coated thereon a silver halide emulsion layer, in an infectious developing solution comprising (1) hydroquinone or a hydroquinone derivative, (2) an alkali, (3) an alkali metal bromide, (4) an alkali metal sulfite, (5) an aldehyde/alkali metal bisulfite adduct, and (6) an antifoggant, the improvement comprising incorporating into the emulsion or into the developer an accelerator in amount sufficient to reduce the induction period of said photographic film; said accelerator being a compound selected from the group consisting of:

(a) a pyrazolo pyrimidine of the structure

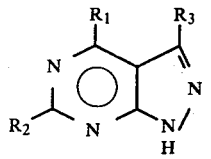

wherein $R_1$ and $R_2$=H, OH, or $NH_2$, with the proviso that when $R_1$=OH, $R_2$ must be H or $NH_2$, and $R_3$=H or —$O(CH_2)_n$—OH, wherein n is an integer from 1 to 3;

(b) a substituted purine of the structure:

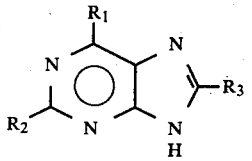

wherein $R_1$=OH or $NH_2$; $R_2$=H, $NH_2$, or OH with the proviso that when $R_1$=OH, $R_2$=H or $NH_2$, and when $R_1$=$NH_2$, $R_2$=H; $R_3$=H, OH, $NH_2$, or $CH_3$ with the proviso that when $R_3$=OH, $R_1$ and $R_2$ may be OH; when $R_3$=$NH_2$, $R_1$ must be OH and $R_2$ must be H; and when $R_3$=$CH_3$, $R_1$ and $R_2$ must be OH.

(c) a 4-aza-benzimidaziole of the structure:

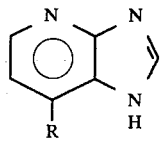

wherein R=H or $NH_2$;

(d) 8-azaguanine

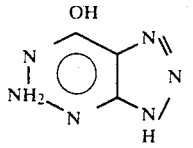

and (e) phthalazine

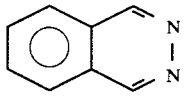

2. The process of claim 1 wherein the photographic film is an exposed litho film, and the accelerator is incorporated into the developer solution.

3. The process of claim 2 wherein the accelerator is incorporated into the developer solution in quantities within the range of 0.0005 to 2 g/liter of solution.

4. The process of claim 1 wherein the accelerator is incorporated into the emulsion in quantities of $1\times10^{-2}$ to 5 millimoles/1.5 moles of silver halide.

5. In a process for developing a photographic light-sensitive material for the graphic arts which comprises image-wise exposing and developing a photographic film comprising a support having coated thereon a silver halide emulsion layer, in a noninfectious developing solution comprising (1) hydroquinone or a hydroquinone derivative, (2) an alkali, (3) an alkali metal bromide, (4) an alkali metal sulfite, and (5) an antifoggant, the improvement comprising incorporating into the emulsion or into the developer and accelerator in amount sufficient to reduce the induction period of said photographic film; said accelerator being a compound selected from the group consisting of:

(a) a pyrazolo pyrimidine of the structure

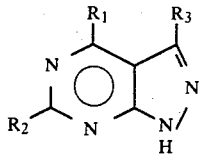

wherein $R_1$ and $R_2$=H, OH, or $NH_2$, with the proviso that when $R_1$=OH, $R_2$ must be H or $NH_2$, and $R_3$=H or $-O(CH_2)_n-OH$, wherein n is an integer from 1 to 3;

(b) a substituted purine of the structure:

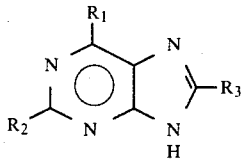

wherein $R_1$=OH or $NH_2$; $R_2$=H, $NH_2$, or OH with the proviso that when $R_1$=OH, $R_2$=H or $NH_2$, and when $R_1$=$NH_2$, $R_2$=H; $R_3$=H, OH, $NH_2$, or $CH_3$ with the proviso that when $R_3$=OH, $R_1$ and $R_2$ may be OH; when $R_3$=$NH_2$, $R_1$ must be OH and $R_2$ must be H; and when $R_3$=$CH_3$, $R_1$ and $R_2$ must be OH.

(c) a 4-aza-benzimidazole of the structure:

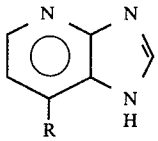

wherein R=H or $NH_2$;

(d) 8-azaguanine

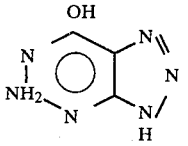

and (e) phthalazine

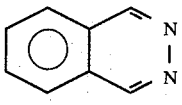

6. The process of claim 5 wherein the photographic film is an exposed litho film, and the accelerator is incorporated into the developer solution.

7. The process of claim 6 wherein the accelerator is incorporated into the developer solution in quantities within the range of 0.0005 to 2 g/liter of solution.

8. The process of claim 5 wherein the accelerator is incorporated into the emulsion in quantities of $1\times10^{-2}$ to 5 millimoles/1.5 moles of silver halide.

* * * * *

UNITED STATES PATENT AND TRADEMARK OFFICE

CERTIFICATE OF CORRECTION

PATENT NO. : 4,292,391

DATED : September 29, 1981

INVENTOR(S) : Joseph DeWitt Overman

It is certified that error appears in the above-identified patent and that said Letters Patent is hereby corrected as shown below:

Column 2, line 20 the formula should appear as shown below:

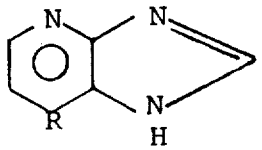

Column 5, line 24, "cooled" should read -- coated --.

Signed and Sealed this

Fourth Day of January 1983

[SEAL]

Attest:

GERALD J. MOSSINGHOFF

Attesting Officer

Commissioner of Patents and Trademarks